US009180600B2

(12) United States Patent
Zhang

(10) Patent No.: US 9,180,600 B2
(45) Date of Patent: Nov. 10, 2015

(54) CUTTING TOOL

(71) Applicant: Charlie Zhang, Oak Brook, IL (US)

(72) Inventor: Charlie Zhang, Oak Brook, IL (US)

(73) Assignee: D-Cut Products, Inc., Downers Grove, IL (US)

( * ) Notice: Subject to any disclaimer, the term of this patent is extended or adjusted under 35 U.S.C. 154(b) by 230 days.

(21) Appl. No.: 13/707,777

(22) Filed: Dec. 7, 2012

(65) Prior Publication Data

US 2014/0157967 A1 Jun. 12, 2014

(51) Int. Cl.

| | |
|---|---|
| ***B26D 5/10*** | (2006.01) |
| ***B26D 1/08*** | (2006.01) |
| ***B26D 5/16*** | (2006.01) |
| ***B26D 7/26*** | (2006.01) |

(52) U.S. Cl.

CPC *B26D 1/085* (2013.01); *B26D 1/08* (2013.01); *B26D 5/10* (2013.01); *B26D 5/16* (2013.01); *B26D 7/2628* (2013.01); *Y10T 83/762* (2015.04); *Y10T 83/8749* (2015.04); *Y10T 83/885* (2015.04); *Y10T 83/8843* (2015.04)

(58) Field of Classification Search

CPC ..... B26D 1/08; B26D 1/085; B26D 5/10; B26D 5/16; B26D 7/2628; Y10T 83/8749; Y10T 83/8843; Y10T 83/762; Y10T 83/885

USPC ..... 83/628, 409, 743, 471.2, 471.3, 472, 83/477, 477.1, 477.2, 522.11–522.24, 83/561–564

See application file for complete search history.

(56) References Cited

U.S. PATENT DOCUMENTS

| | | | | |
|---|---|---|---|---|
| 4,328,728 | A * | 5/1982 | Ferdinand et al. | 83/471.3 |
| 4,579,027 | A * | 4/1986 | Lewis | 83/28 |
| 5,255,587 | A * | 10/1993 | Eichenberg et al. | 83/628 |
| 2009/0301277 | A1 * | 12/2009 | Ipatenco et al. | 83/471 |
| 2010/0263512 | A1 * | 10/2010 | Zhang | 83/628 |

* cited by examiner

*Primary Examiner* — Ned Landrum
*Assistant Examiner* — Nhat Chieu Do
(74) *Attorney, Agent, or Firm* — Pauley Erickson & Kottis

(57) ABSTRACT

A cutting tool for cutting sheets of building materials, such as, for example, laminate baseboards, chair rails and crown molding, at an angle. The cutting tool includes a base connected to a cutting platform with a hinge connection. The cutting platform further includes a blade that can be moved downward on the cutting platform to cut the building material. The hinge connection allows the cutting platform to be angled relative to the base to cut the building material at a range of angles from 0°, vertical, to 60° or more.

20 Claims, 16 Drawing Sheets

CUTTING TOOL

BACKGROUND OF THE INVENTION

1. Field of the Invention

This invention relates to a cutting tool for cutting sheets of building materials, for example laminate, at a range of angles from vertical and/or horizontal. More specifically, this invention relates to a cutting tool including a base, a cutting platform adjustably connected to the base, a cam pivotally connected to the cutting platform, and a blade, the blade movable downward by pivoting the cam.

2. Discussion of Related Art

Often carpenters need to cut building materials, such as baseboards and crown molding, with a beveled or mitered cut in order to fit in or around corners. Various tools are currently used to cut building materials with a beveled cut, however most are bulky, heavy, require power to be operated, produce large amounts of dust during the cutting process, and/or result in uneven or splintered cuts. Accordingly, there is a need for an improved cutting tool for cutting building materials with beveled cut. There is a need for a portable, non-power operated cutting tool capable of cutting building materials with a vertical or beveled cut and in a predictable and straight fashion without splintering, cracking or similar problems and without creating dust.

SUMMARY OF THE INVENTION

The present invention provides a portable, non-power operated cutting tool for cutting sheets of building materials at a range of angles in both a vertical and horizontal direction without splintering or cracking.

According to an embodiment of this invention, the cutting tool includes a base with a cutting platform connected to the base with a pivotable connection for example, but not limited to, a hinge and an axle. The cutting platform preferably includes a pair of supports. The supports are preferably positioned on either side of the cutting platform with a cam connected to at least one of the supports. A blade holder, with a blade, is positioned under the cam and aligned the cutting platform. In a preferred embodiment, a handle is connected to the cam to assist in rotating the cam. The blade holder and the blade are moveable between an open position and a closed position by pivoting the cam. In the open position, the cam contacts the blade holder at a relatively small radius, as the cam rotates, the blade holder contacts the cam at a gradually increasing radius until the blade holder and the blade are in a closed position.

According to a preferred embodiment, as the blade holder travels from the open position to the closed position, the blade holder is maintained in a generally straight path by the supports or a pair of guide pins. A hole in the blade holder is of slightly larger diameter than the support so that the path of travel of the blade holder is maintained straight providing a consistent and repeatable cutting motion. In a preferred embodiment, a spring is positioned between the support and the blade holder. The spring biases the blade holder in the open position and as the blade holder travels downward, the spring is compressed to further urge a uniform cut of the blade through the material.

According to a preferred embodiment of this invention, the base and the cutting platform are connected with a lockable hinge that allows the cutting platform, guide pin, blade holder and cam to be angled relative to the base. With this arrangement, the cutting tool of this invention can cut a building material with a vertical cut or an angled cut, such as a 45° miter cut from vertical. Preferably, the lockable hinge allows the cutting surface to be locked into a range of angles, ranging from 0° to 60°. In an embodiment of this invention, the handle is adjustable relative to the cam, allowing for the cutting tool to move through a full range of motion, from the open position to the closed position, for all angled cuts.

According to a preferred embodiment of this invention, the base further includes a guide rail for aligning the building material to the blade. The guide rail is adjustable, allowing the building material to set at a range of angles to the blade in a horizontal plane.

DESCRIPTION OF THE INVENTION

Figure 1:
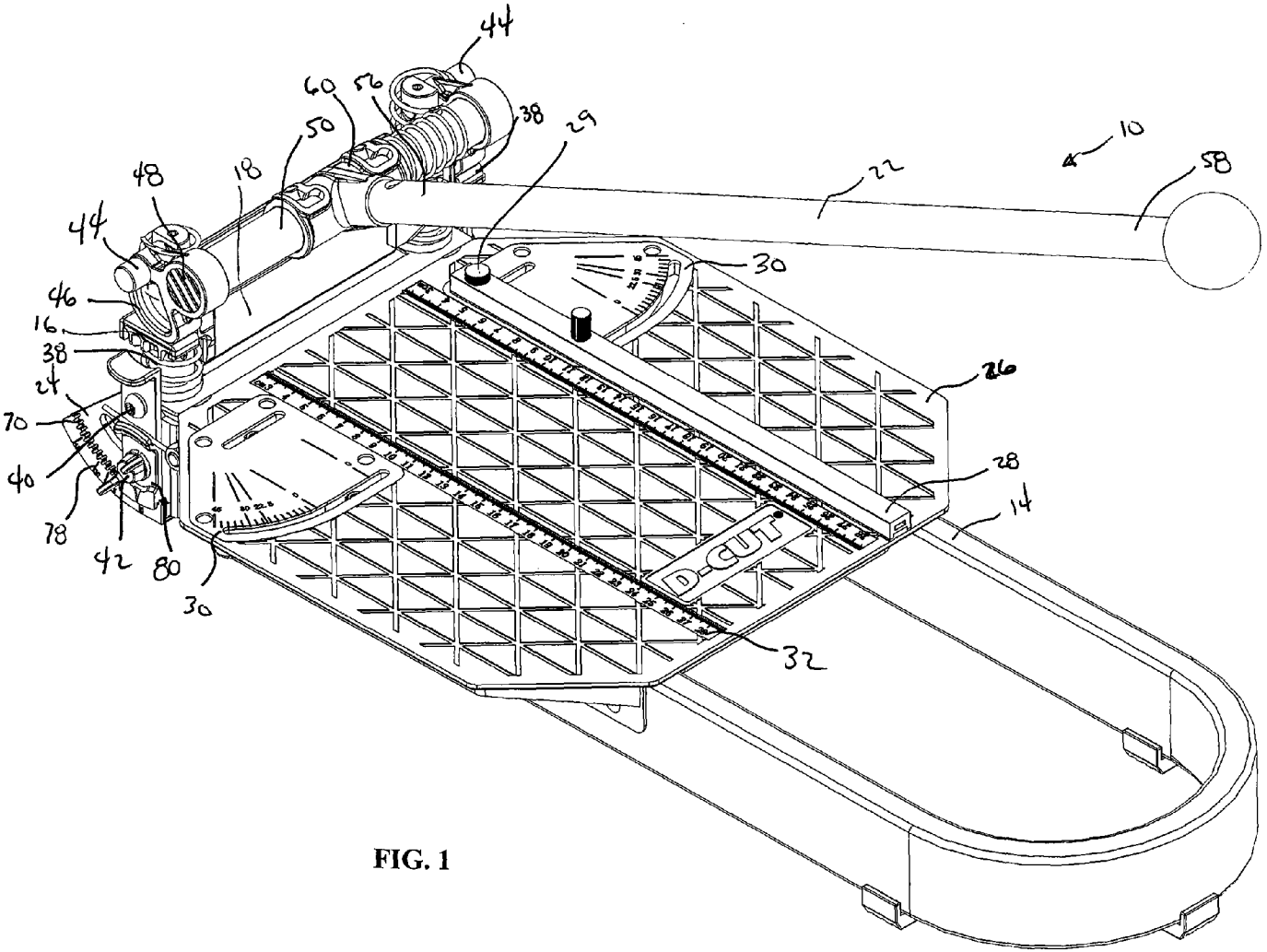
FIG. 1 is a perspective view of a cutting tool in a closed position according to one embodiment of this invention.
Figure 2:
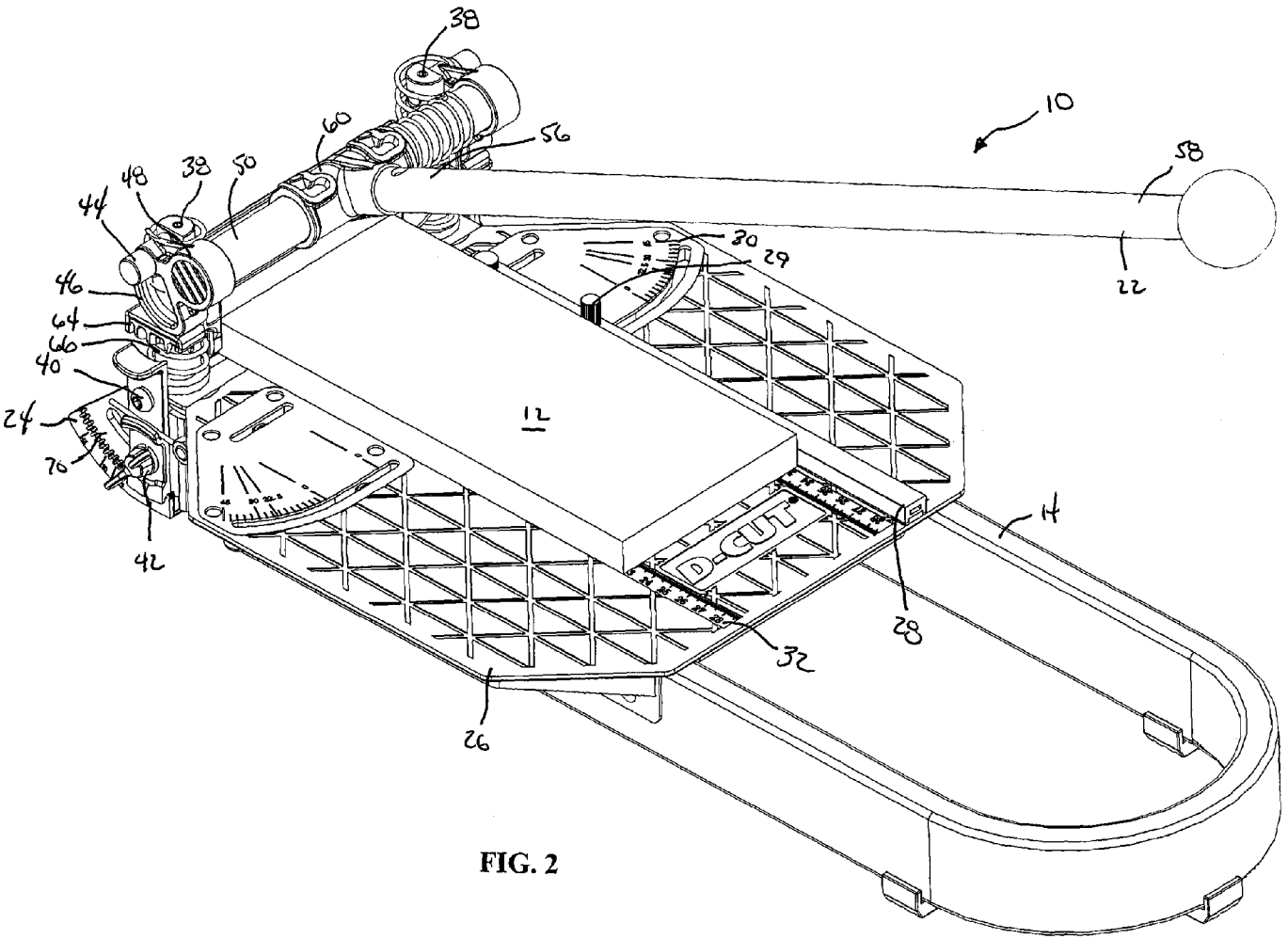
FIG. 2 is a perspective view of the cutting tool shown in FIG. 1 with a sheet of material.

FIGS. 1 and 2 show a perspective view of a cutting tool 10 according to one embodiment of this invention. The cutting tool 10 as described is preferably used to cut building materials 12, such as laminate, in a predictable and straight fashion without splintering, cracking or similar problems that may arise from such cuts. The cutting tool 10 is capable of cutting the building material 12 at a range of angles from 0°, vertical, to approaching 90°, and preferably ranging from 0° to 60° from vertical. The cutting tool 10 is also capable of cutting the building material at a range of angles in a horizontal plane, ranging from 0°, perpendicular to the blade, to 45° or more. The vertical adjustment allows the cutting tool 10 to cut materials to, for example, fit around or in corners and the horizontal adjustment allows the cutting tool 10 to cut materials to, for example to fit around window or door frames.

As used herein, "material" refers to a sheet or plank of building material, such as baseboards, crown molding, chair rail molding, wood flooring, laminate flooring, composite flooring, vinyl flooring, vinyl siding, vinyl composition tile or similar materials, including, but not limited to, one or more combinations of wood, fiber, concrete, plastic and/or other materials that may or may not include a laminated layer.

As shown in FIGS. 1-8, the cutting tool 10 includes a base 14, a cutting platform 16, a blade holder 18 and blade 20, and a handle 22. The cutting platform 16 is preferably connected to the base 14 with an adjustable, lockable, pivotable connection 23 allowing the cutting platform 16 to be set at a plurality of angles to the base 14. For example, the pivotable connection 23 may comprise a hinge, an axle or any other connection that allows the cutting platform 16 to pivot relative to the base 14.

In an embodiment of the invention, the base 14 comprises a U-shape base that provides stability for the cutting tool 10, however the base 14 is not limited to this shape and may comprises any shape that provides a stable base for the cutting tool 10. The base 14 may be formed of steel, aluminum or another material with durable qualities capable of withstanding the force required to cut the building materials 12.

The base 14 preferably includes a support surface 26 for accommodating the material 12 to be cut. The support surface 26 preferably includes a textured or a high friction, non-slip surface that prevents the building material from slipping or moving during cutting process. The support surface 26 is preferably made of lightweight and durable materials, such as plastic, rubber, metal and composite materials, but may be made of any material capable of supporting the building materials 12 and withstanding the cutting force. The base 14 and support surface 26 are preferably sized to accommodate standard sizes of materials 12, such as a baseboard, and may correspond in width to such material 12.

The cutting tool 10 preferably further includes an adjustable guide rail 28 and a track 30 on the support surface 26 that can be used to align the building material 12 at a range of angles, along a horizontal plane, to the blade 20. In the embodiment shown in FIG. 1, the guide rail 28 is connected to one of the tracks 30 with a pair of adjustment screws 29. The guide rail 28 is positioned perpendicular to the blade but can be moved along the track 30 to provide additional room for the building material 12 and/or adjusted to a range of angles to the blade 12 from 0°, perpendicular to a 45° or more. The support surface may further include a ruler 32 for measuring the material 12 to be cut.

Figure 3A:
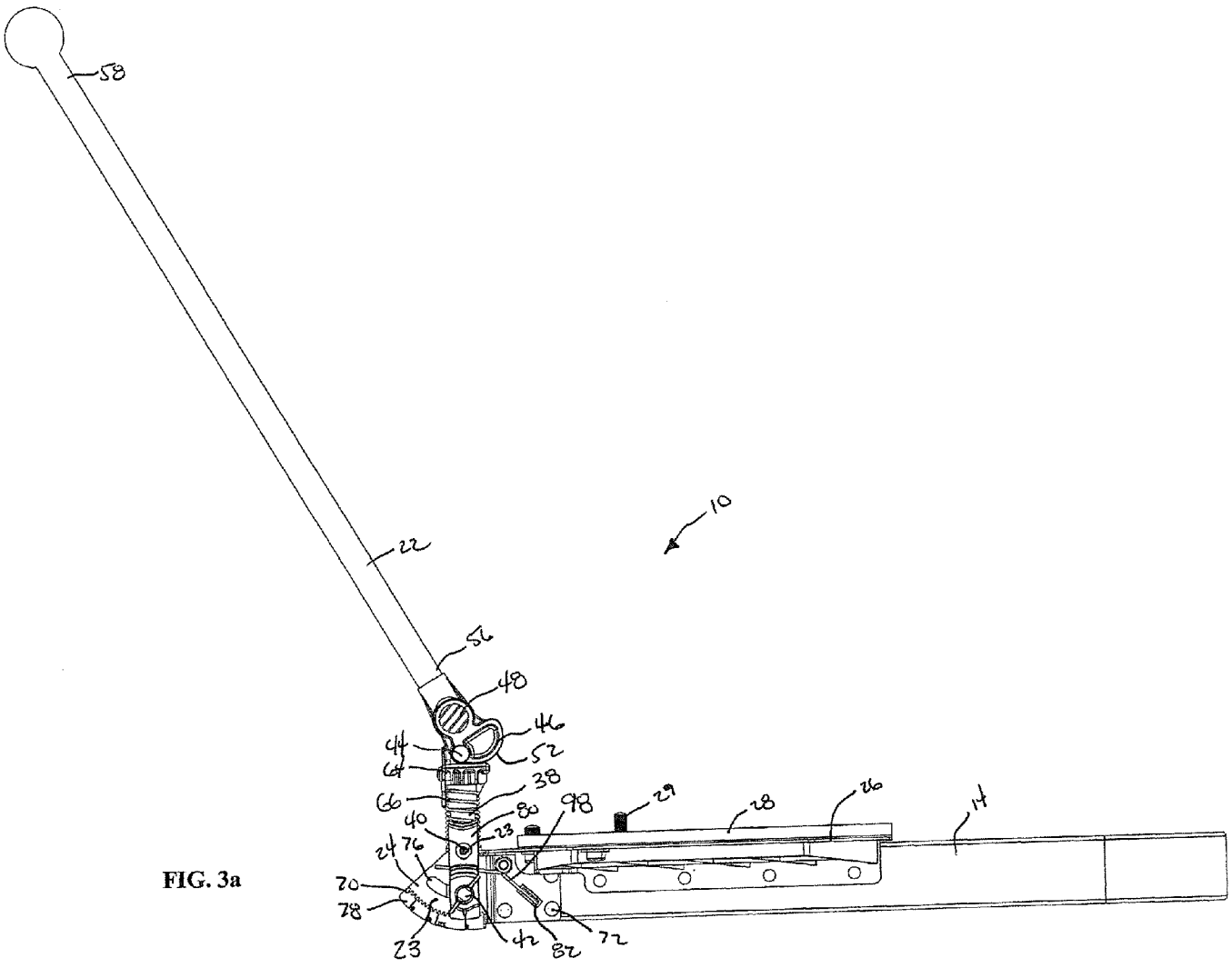
FIG. 3*a* is a side view of the cutting tool shown in FIG. 1 in an open position.
Figure 3B:
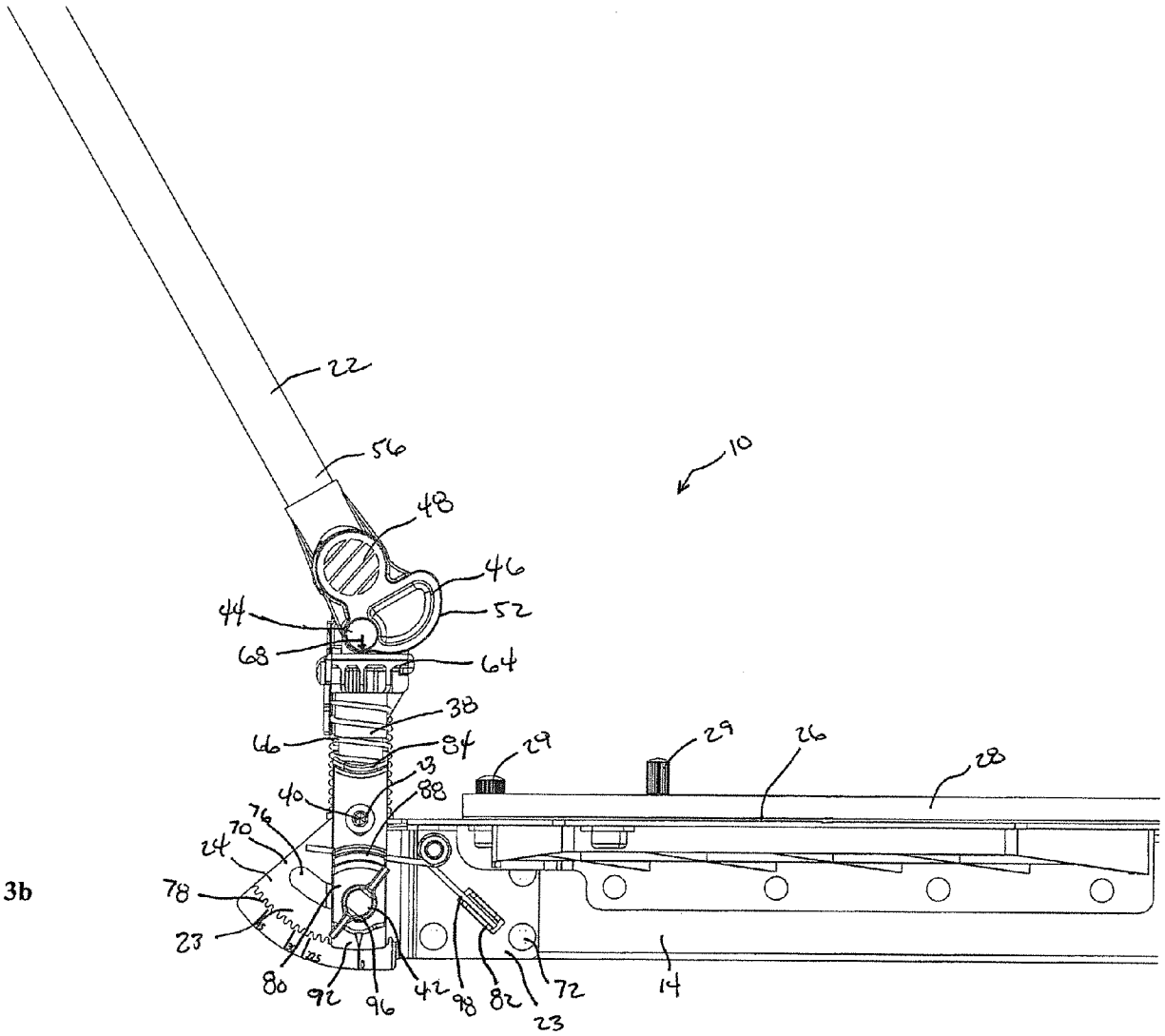
FIG. 3*b* is a close-up of the side view shown in FIG. 3*a*.
Figure 4A:
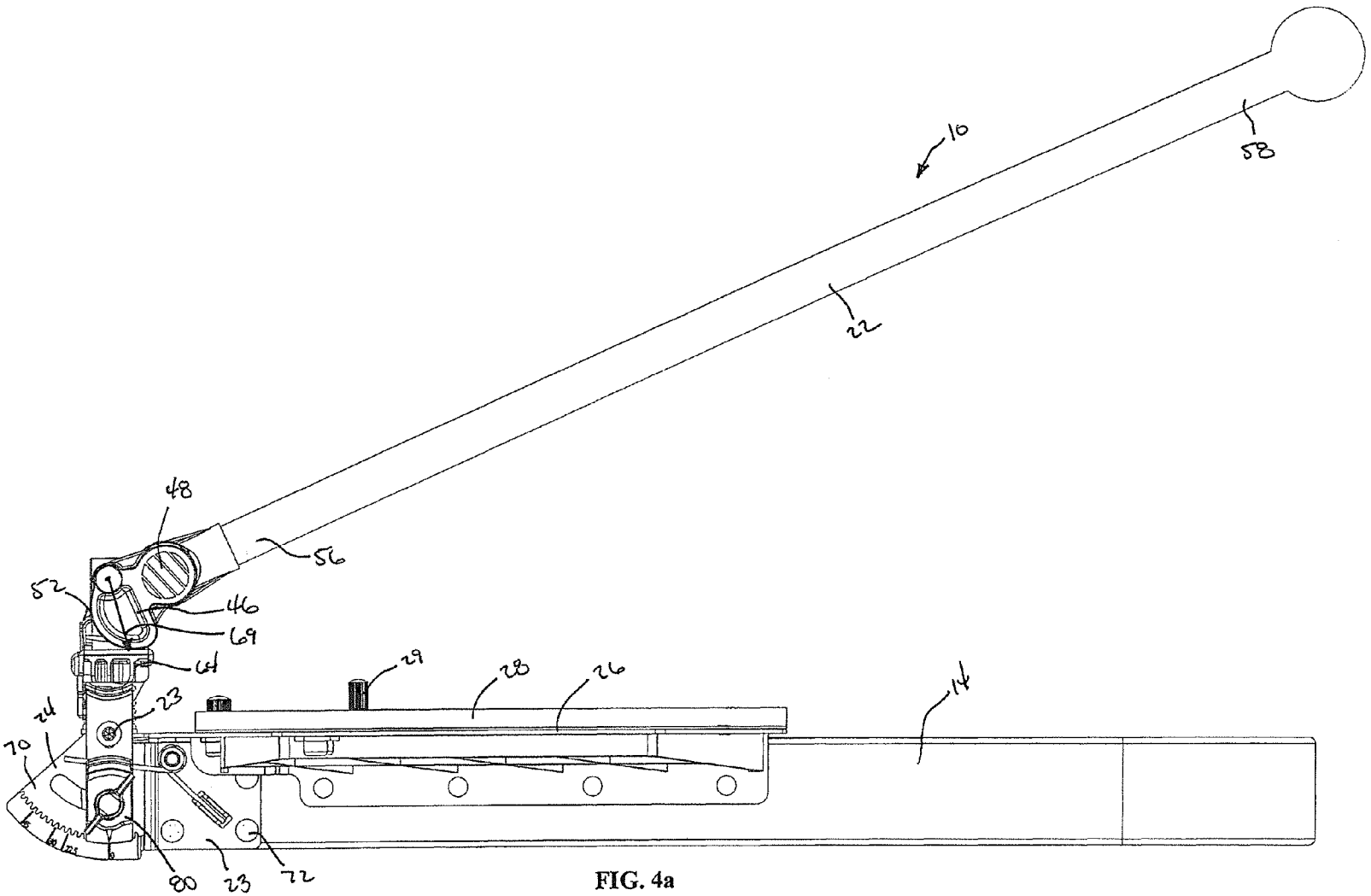
FIG. 4*a* is a side view of the cutting tool shown in FIG. 1 in the closed position.
Figure 4B:
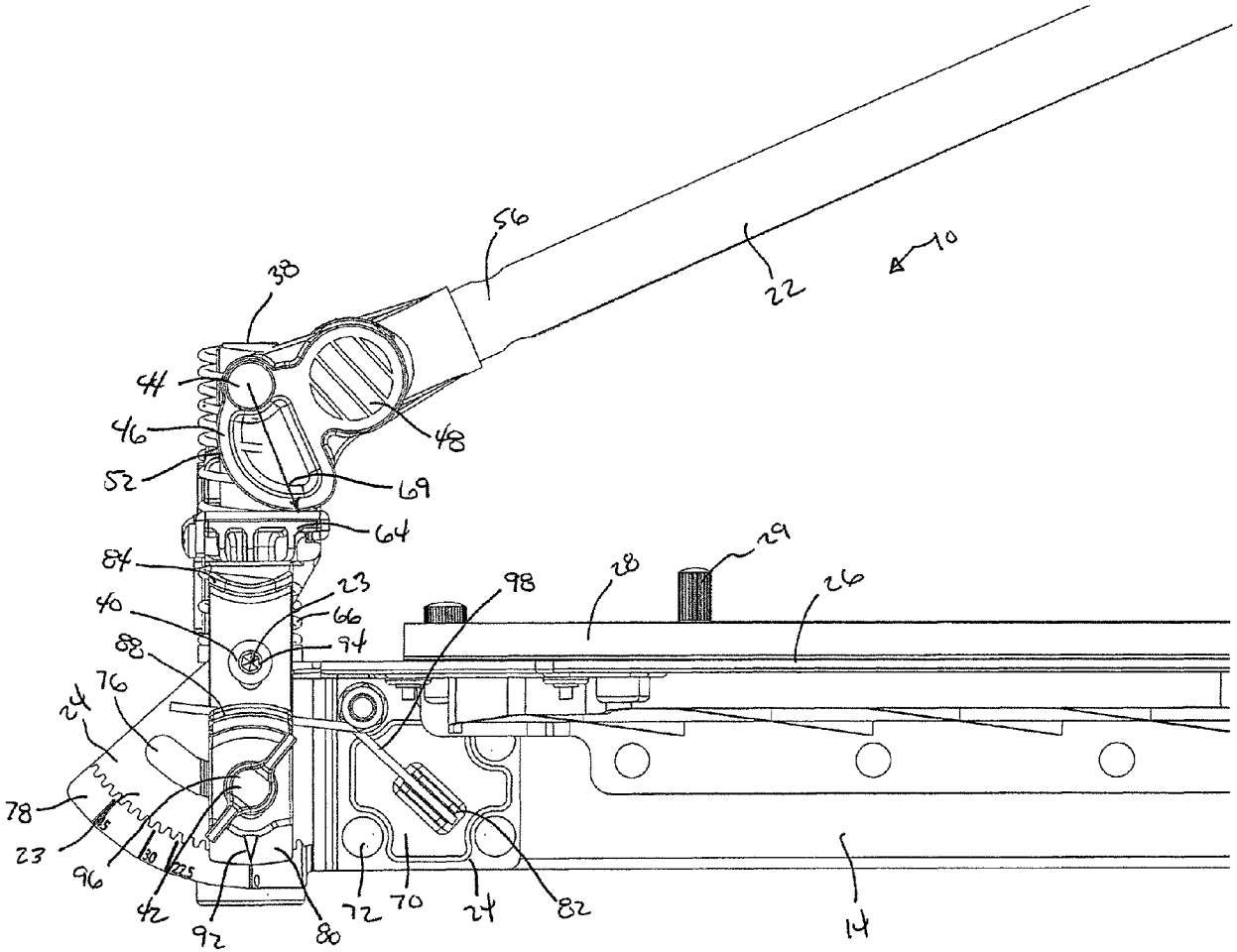
FIG. 4*b* is a close-up of the side view shown in FIG. 4*a*.
Figure 5A:
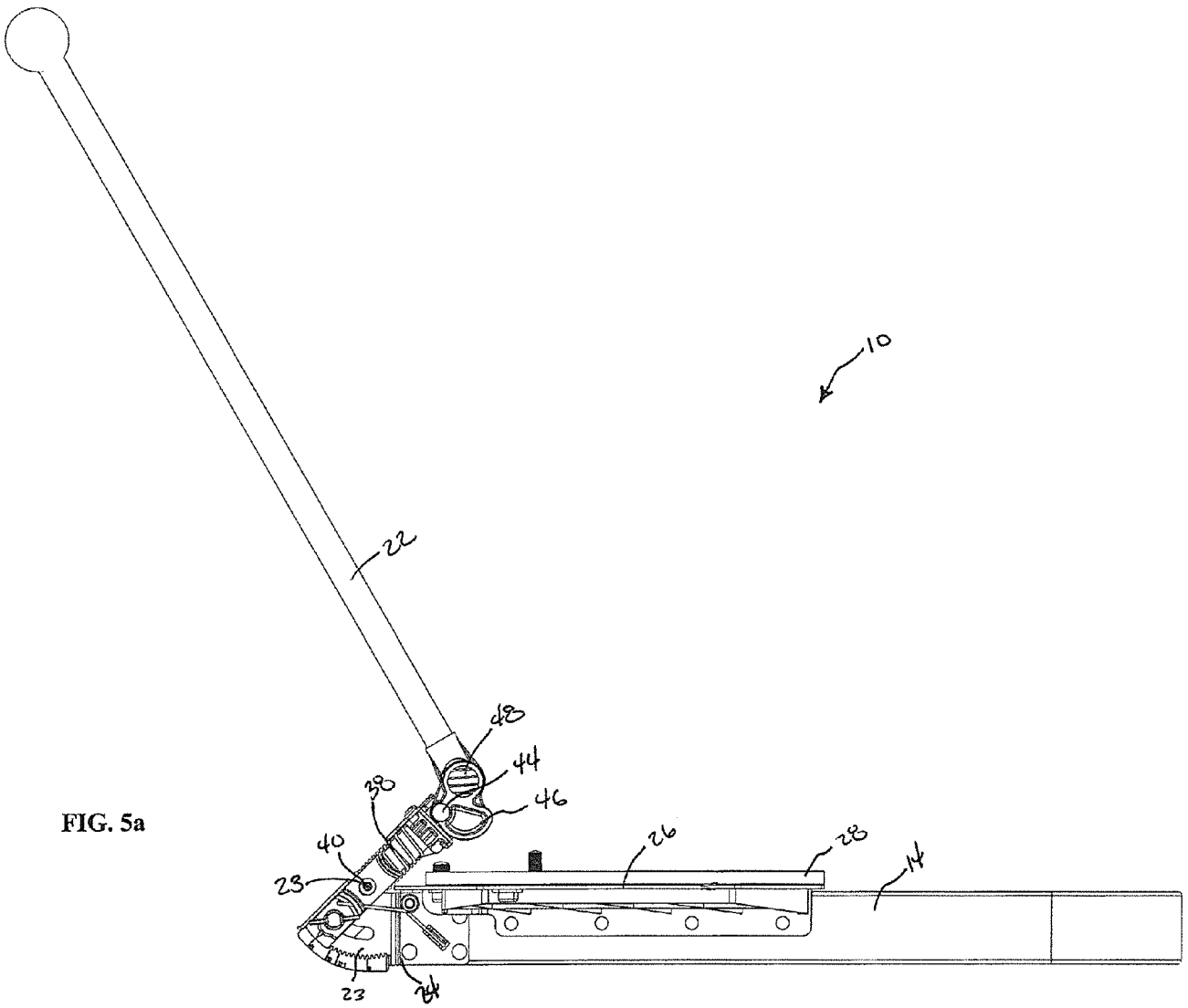
FIG. 5*a* is a side view of the cutting tool shown in FIG. 1 in the open position with a cutting platform set at a 45° angle.
Figure 5B:
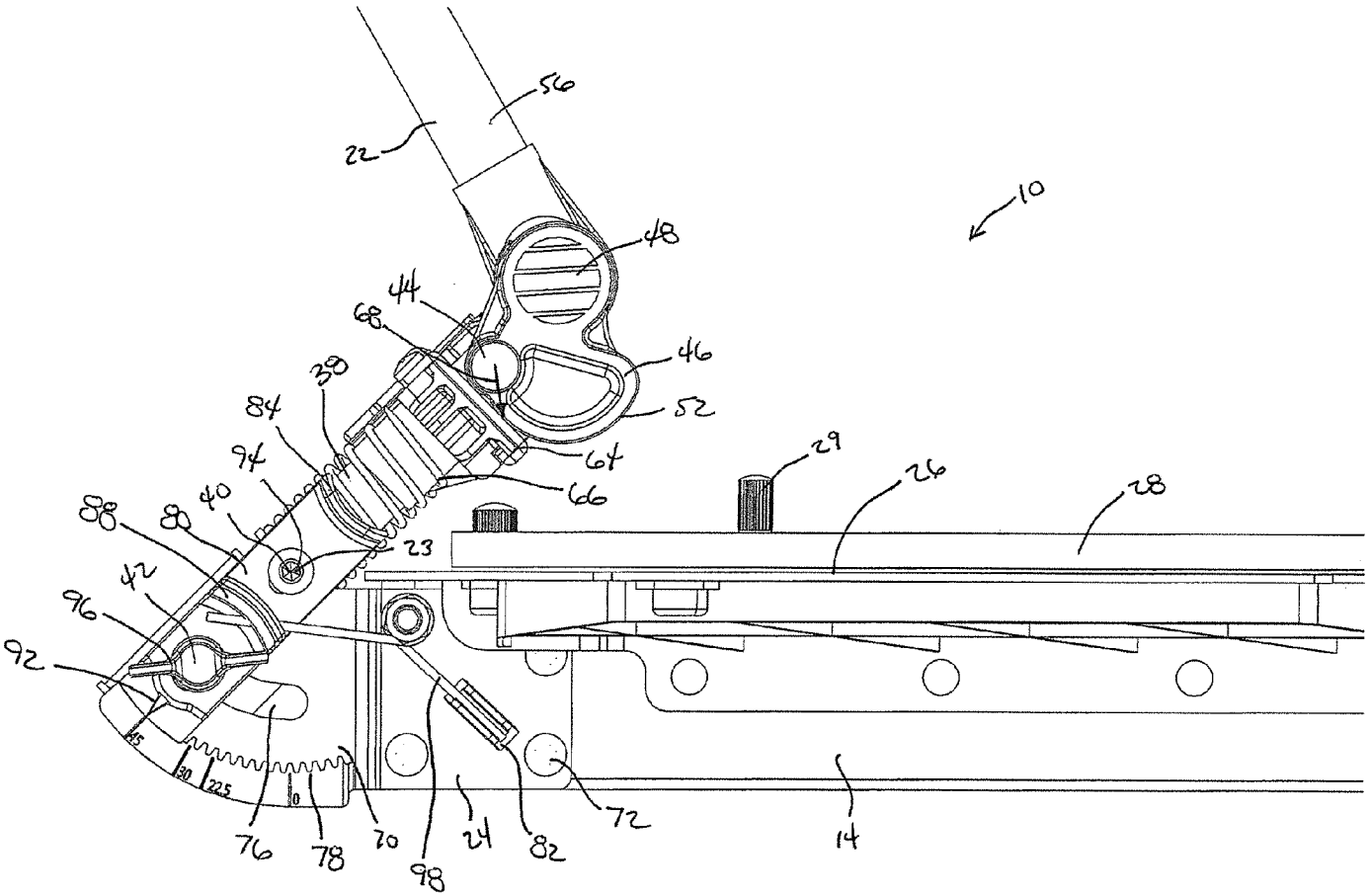
FIG. 5*b* is a close-up of the side view shown in FIG. 5*a*.

In a preferred embodiment of this invention, the cutting platform 16 is connected to the base 14 with the hinge 24 allowing the cutting platform 16 to be set at a plurality of angles to the base 14. For example, FIGS. 3*a-b* and 4*a-b* show the cutting platform 16 aligned with the base 14 for a vertical cut or 0° cut. FIGS. 5*a-b* show the cutting platform 16 aligned with the base 14 for a 45° cut. In the embodiment of FIGS. 3*a*-5*b*, the cutting platform 16 can be set at a plurality of angles ranging from 0° to greater than 45°. However, the cutting tool 10 of this invention can be designed to cover any range of angles including from 0° to approaching 90°.

Figure 9A:
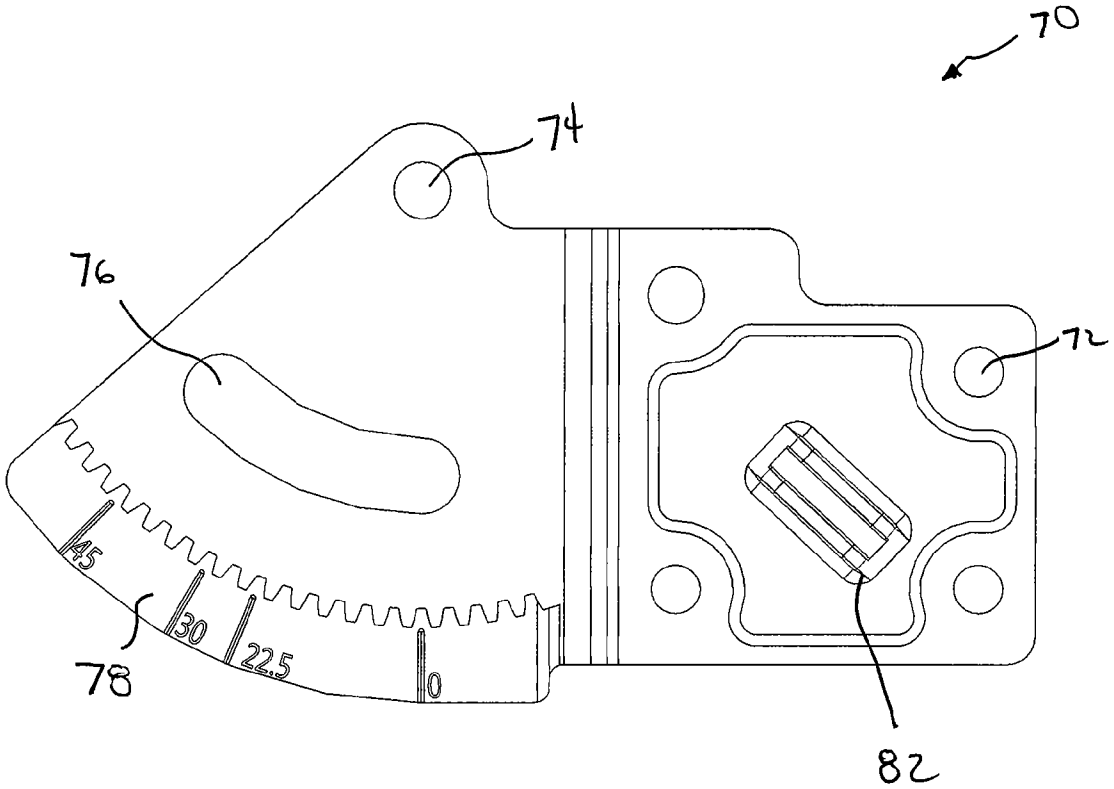
FIG. 9*a* is a side view of a hinge plate according to an embodiment of this invention.
Figure 9B:
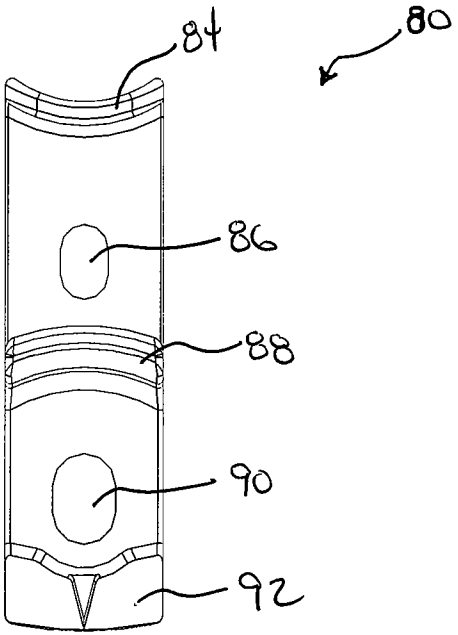
FIG. 9*b* is a side view of a hinge lock according to an embodiment of this invention.

FIGS. 9*a-b* shows an embodiment of two components of hinge 24 separate from the other components of the cutting tool 10. FIG. 9*a* shows an embodiment of a hinge plate 70 of the hinge 24. FIG. 9*b* shows an embodiment of a hinge lock 80 of the hinge 24.

The hinge plate 70 comprises a plurality of attachment points 72 for connecting the hinge plate 70 to the base 14 with rivets, threaded connectors or any other type of connectors. In an alternative embodiment, the hinge plate 70 can be connected to the base 14 with a weld connection or integrally formed with the base 14. The hinge plate 70 further includes an axle hole 74, a platform slot 76, a rack 78 and a spring mount 82 for adjusting the position of the cutting platform 16 to the base 14. As shown in FIG. 9*b*, the hinge lock 80 includes a lift 84, an oval axle hole 86, a spring catch 88, an oval platform hole 90 and a locking projection 92. The cutting platform 16 is connected to the hinge 24 with a platform axle 40 and a platform projection 42. The platform axle 40 extends through the axle hole 74 and the oval axle hole 86 of the hinge 24 and is secured with a fastener 94, providing an axis of rotation for the cutting platform 16. The platform projection 42 extends through the platform slot 76 and the oval platform hole 90 of the hinge 24 and secured with a fastener 96 preferably a wing nut, limiting the rotation of the cutting platform 16 to an angle range defined by the platform slot.

To lock the cutting platform 16 to an angle, the cutting platform 16 and the hinge lock 80 are aligned with the desired angle on the rack 78. A hinge spring 98 positioned between the spring mount 82 and the spring catch 88 presses the locking projection into the teeth of the rack 78 locking the cutting platform to the desired angle. Preferably, the cutting platform 16 is further secured by tightening the wing nut 96 or another similar mechanical connector. To adjust the angle of the cutting platform 16, the wing nut 96 is loosened and the lift 84 pulled upward, disengaging the locking projection 92 from the teeth of the rack 78. The cutting platform 16 is rotated about platform axle 40 and through the platform slot 76 to the newly desired angle. The lift 84 is released allowing the locking projection 92 to mate with the teeth of the rack 78 and the wing nut 96 is retightened, securing the cutting platform 16 at the new angle. In an alternative embodiment, the hinge 24 may not include the rack 78, the spring mount 82, the lift 84, the spring catch 88, the locking projection 92, and/or the hinge spring 98. In this alternative embodiment, the cutting platform is secured by tightening the wing nut 96 at a desired angle.

Figure 6A:
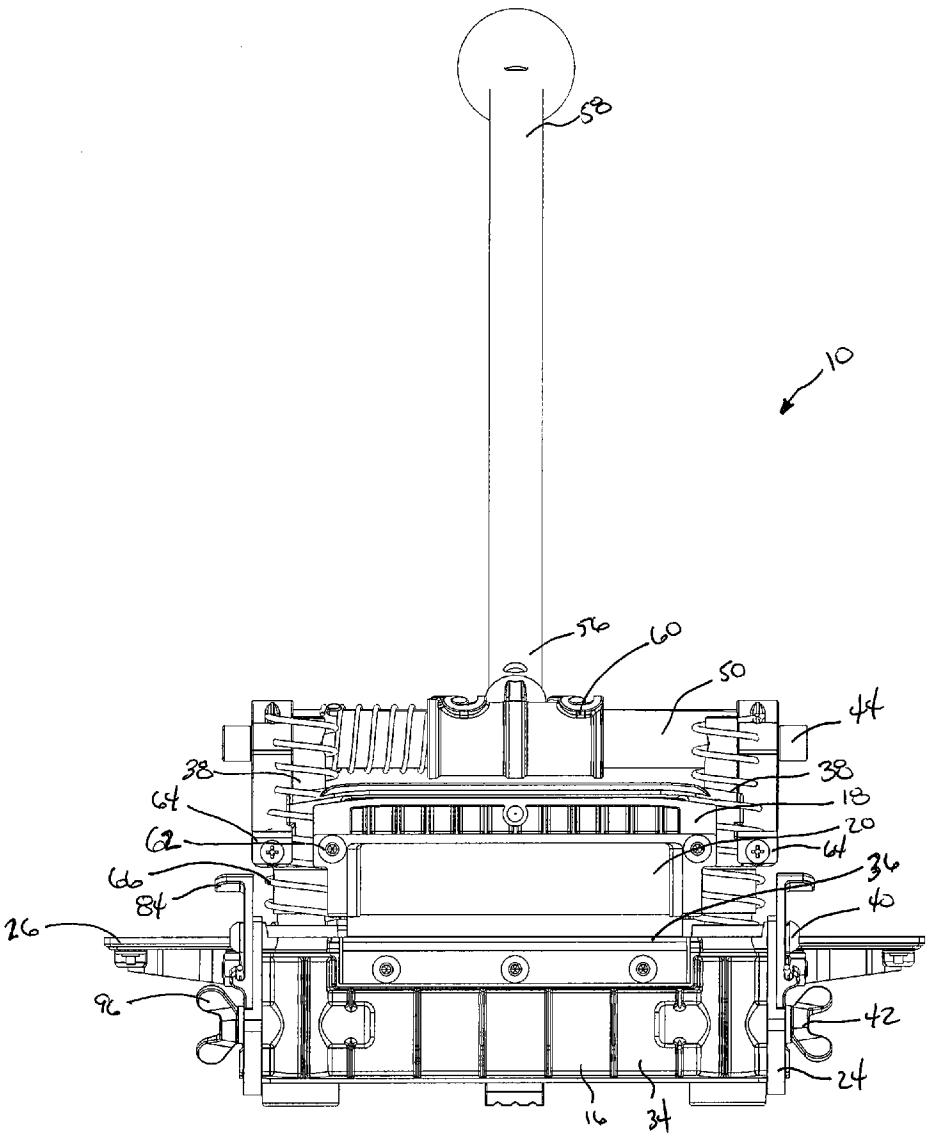
FIG. 6*a* is a rear view of the cutting tool shown in FIG. 1 in the closed position.
Figure 6B:
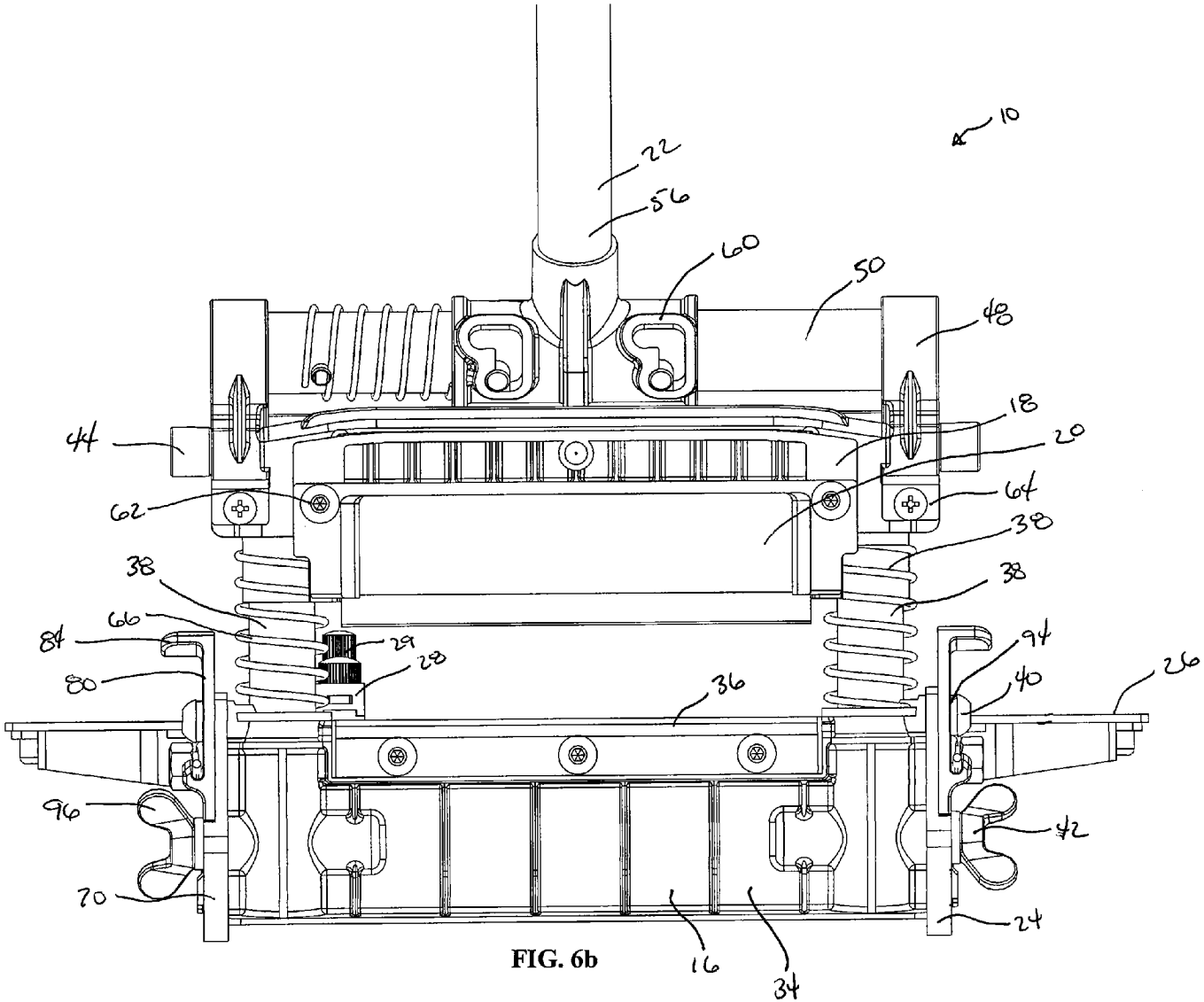
FIG. 6*b* is a rear view of the cutting tool shown in FIG. 1 in the open position.
Figure 7:
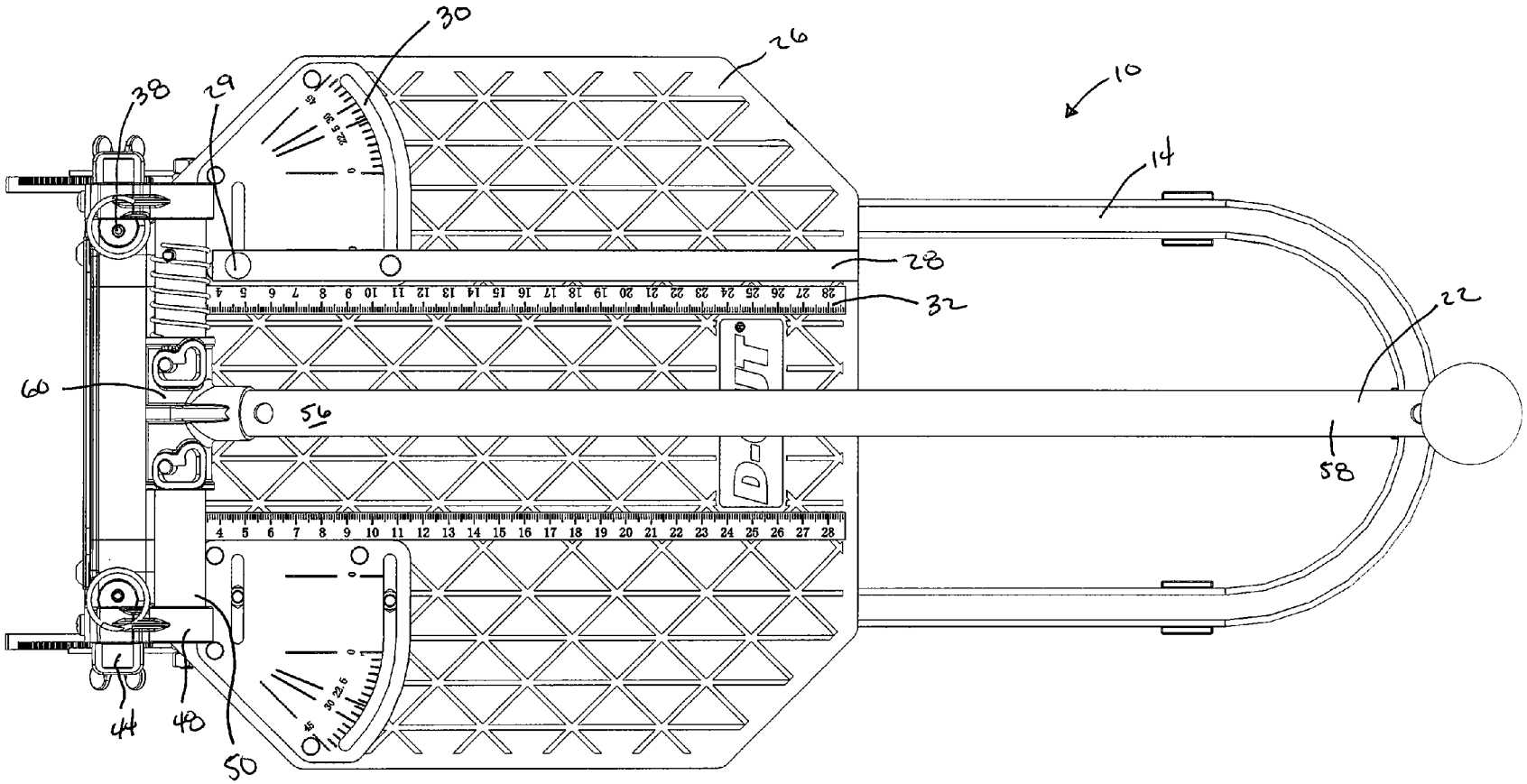
FIG. 7 is a top view of the cutting tool shown in FIG. 1.
Figure 8:
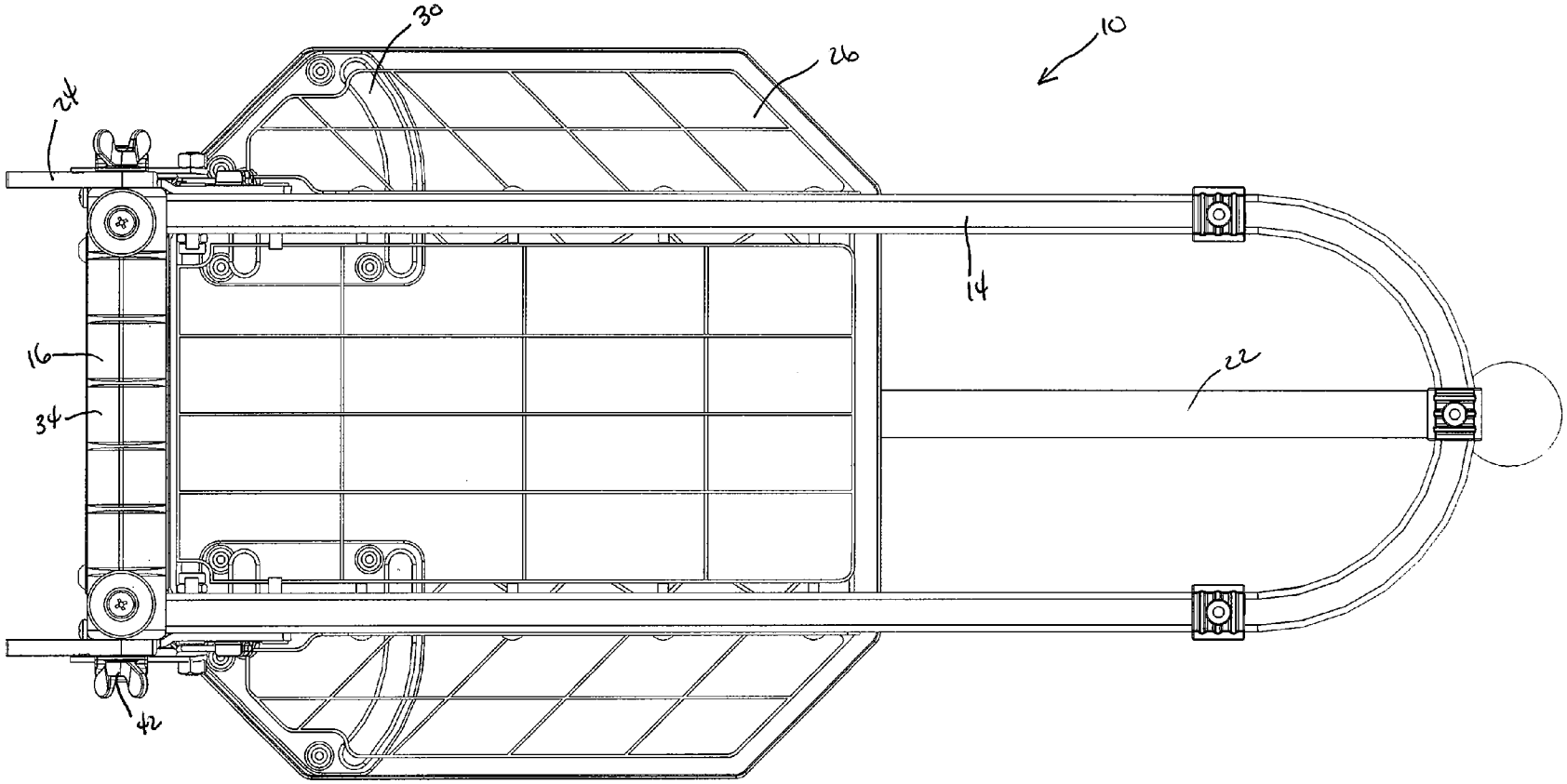
FIG. 8 is a bottom view of the cutting tool shown in FIG. 1.

In a preferred embodiment of this invention, as best shown in FIGS. 6*a-b*, the cutting platform includes a cutting platform base 34, a blade stop 36, and a pair of supports 38 extending from the cutting platform base 34. The cutting platform 16 is preferably manufactured of steel but may comprise any material or materials capable of withstanding the force required to push the blade 20 through the building material 12.

Figure 10:
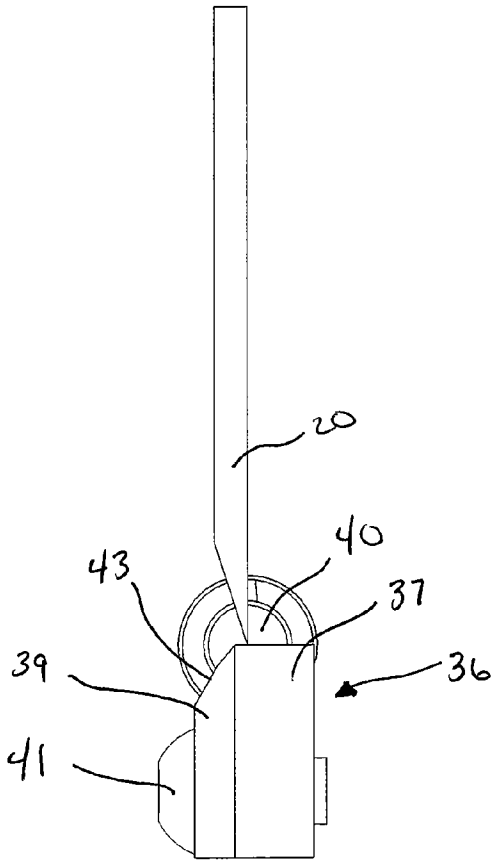
FIG. 10 is a side view of a blade, a blade stop and a platform axle according to one embodiment of this invention.

In a preferred embodiment, as best shown in FIG. 10, the blade stop 36 includes a contact element 37 and a brace 39. The contact portion 37 is preferably manufactured of a softer material that causes minimal damage to an edge of the blade 20 such as, but not limited to, nylon. The brace 39 is preferably manufactured of a durable material such as, but not limited to, steel and aluminum. Preferably, the contact element 37 and the brace 39 are connected to the cutting platform base 34 with a threaded connection 41 that allows the contact portion 37 to be easily replaced as it wears. As best shown in FIG. 10, in a preferred embodiment, the brace 39 includes a sloped top edge 43. This sloped edge 43 prevents the blade stop 36 from projecting over a plane of the support surface 26 as the cutting platform 16 is set to an angle other than 0°.

As best shown in FIGS. 6*a-b*, the pair of supports 38 are connected to the cutting platform base 34 extending generally perpendicular to a plane of the blade stop 36. The pair of supports 38 may be formed of materials such as steel or similar rigid material. In this embodiment, the pair of supports 38 are integrally formed with the cutting platform base 34 and are positioned on either side of the cutting platform base 34 at a width sufficient to accommodate standard sizes of material 12, such as but not limited to base boards and crown molding. In other embodiments, the pair of supports 38 can be welded to or connected with a mechanical connection, such as a threaded connection, to the cutting platform base 34 or connected in any other means known to one of skill in the art. In an alternative embodiment, the cutting tool 10 may include a single support 38.

As shown in the figures, each support 38 includes an axle 44 connected to a cam 46. Each cam 46 includes an offset 48, the pair of offsets 48 are connected by a beam 50. In an alternative embodiment, the offsets 48 and beam 50 can be replaced with a single axle, not shown, extending between the pair of supports 38 and the cam 46 connected to the single axle. As shown in FIGS. 3*b*, 4*b* and 5*b*, each cam 46 further includes a cam edge 52 with at least two radii and preferably with a gradually increasing radius.

In a preferred embodiment, this invention includes the handle 22 with a proximate end 56 and a distal end 58. The proximate end 56 is attached to the beam 50 to assist a user to rotate the cams 46. In a preferred embodiment, the proximate end 56 is connected to the beam 50 with an adjustable connection 60. The adjustable connection 60 allows the handle 22 to be set in at least two positions to compensate for the angle of the cutting platform 16, allowing the handle 22 to rotate fully from the open position to the closed position and to prevent the handle 22 from contacting the base 14. In an alternative embodiment, the handle may not include the adjustable connection and the attachment can be formed in various ways including, but not limited to, a threaded connection, a welded connection or an integral connection with the beam 50. The distal end 58 of the handle 22 preferably includes a hand grip for the user to manually grab or engage. In an alternative embodiment, the handle 22 may be extendible to provide a longer lever for cutting the material 12.

As shown in FIGS. 6*a-b*, the blade holder 18 and the blade 20 are positioned between the pair of supports 38, where the pair of supports act as guides for the blade holder 18 to maintain a generally straight path as the blade holder 18 moves from the open position to the closed position. The blade holder 18 may be formed of a material such as steel or similar rigid material. The blade 20 is preferably formed of steel or another material capable of repeatedly cutting all thicknesses and compositions of material 12. In a preferred embodiment, the blade 20 is attached to the blade holder 18 with a threaded connection 62. With this arrangement, the blade 20 can be removed from the blade holder for repairs, sharpening and to select a specialty blade for a type of material 12. In an alternative embodiment, the blade can be integrally formed with the blade holder 18.

As best shown in FIGS. 6*a-b*, each outer edge of the blade holder 18 at least partially surrounds a respective support 38. Outside of each support 38, the blade holder 18 includes a shoulder 64. Each shoulder 64 is positioned under and in contact with a respective cam 46. As each cam 46 rotates, the increasing radius of the cam edge 52 forces the shoulder 64 and the blade holder 18 downwards from the open position to the closed position. In an alternative embodiment, the cam 46 may contact the blade holder 18 at a position between the two supports 38.

According to a preferred embodiment, the blade holder 18 and blade 20 are biased upward into the open position by a spring 66. As shown in the figures, the spring 66 is positioned between the cutting platform 16 and the blade holder 18. In this embodiment, the spring 66 wraps around the support 38. In an alternative embodiment, the spring 66 may not wrap around the support 38. As the blade holder 18 travels downward, the spring 66 is compressed to further urge a uniform cut of the blade 20 through the material 12. The strength and configuration of the spring 66 may be adjusted depending on the desired application.

In a preferred embodiment, the blade 20 moves downward in a plane that is coplanar with the axis of rotation of the platform axle 40 and, as best shown in FIG. 10, the blade 20 contacts the blade stop 36 along a line that is collinear with the axis of rotation of the platform axle 40 of the cutting platform. Specifically, in this embodiment, the blade 20 contacts the nylon contact portion at 1 mm from the brace 39. This arrangement maintains the alignment of the blade 20 to provide a straight cut through the material 12, regardless of the selected angle of the cutting platform 16 and prevents splintering and/or cracking the material 12.

In operation, the cutting tool 10 of this invention starts in the open position as shown in FIGS. 3*a-b*, 5*a-b* and 6*b*. In the open position, the spring 66 biases the blade holder 18 and the blade 20 upward and the cam 46 contacts the shoulder 64 of the blade holder 18 at a relatively small radius 68, this provides an opening between the blade 20 and the blade stop 36 of the cutting platform 16. The material 12 to be cut is placed onto the support surface 26 of the base 14 and through the opening formed between the blade 18 and the cutting platform 16. To cut the material 12, the handle 22 is lowered to rotate the cam 46. By rotating the cam 46, a gradually increasing radius of the cam edge 52 pushes the blade holder 18 and blade 20 downward through the material 12 until a large radius 69 of the cam 46 contacts the shoulder 64 and the blade 20 contacts the blade stop 36 thereby severing the material 12. The resulting cut is optimally free of splinters and a resulting cut end of the material is otherwise clean and straight.

Figure 11:
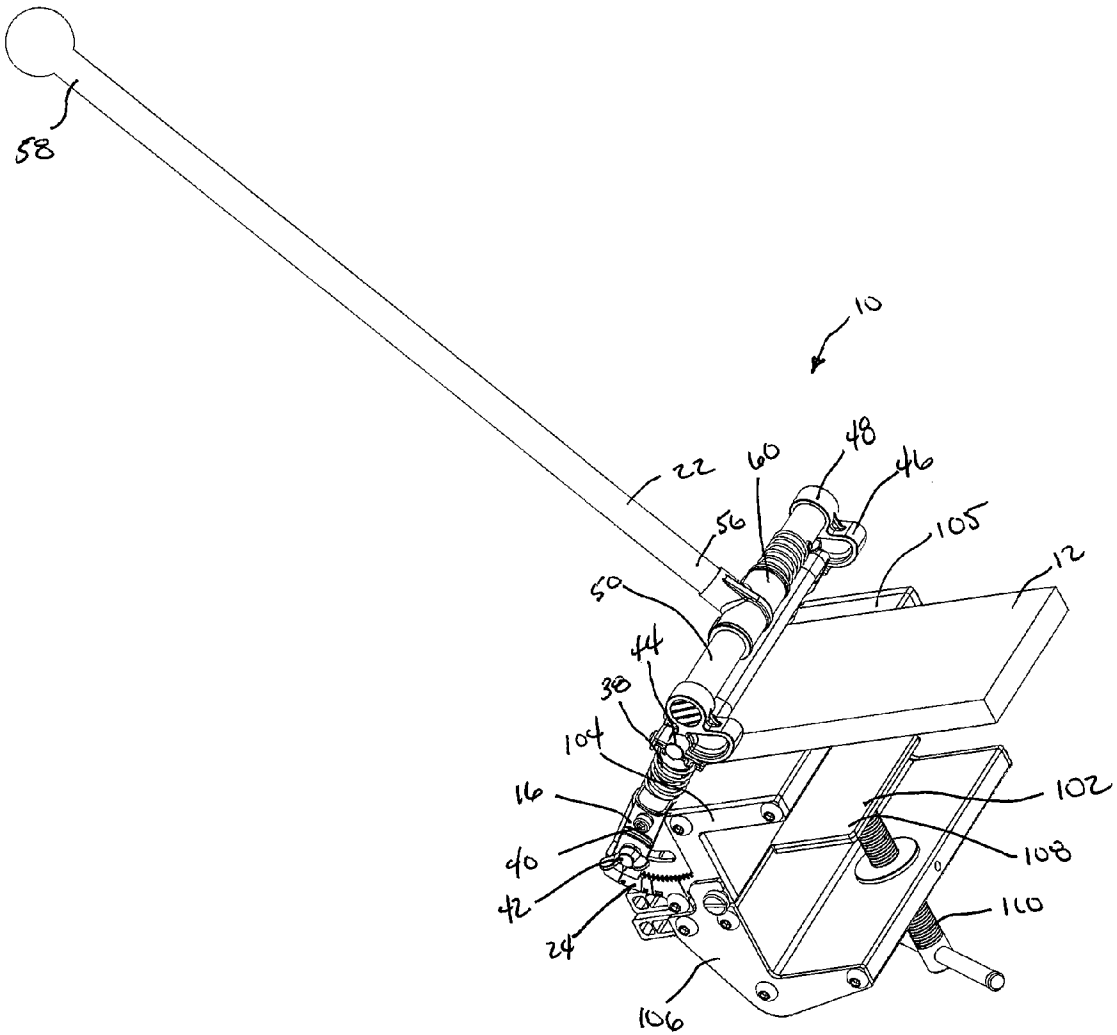
FIG. 11 is a perspective view of another embodiment of the cutting tool of this invention.

In an alternative embodiment of this invention, the cutting tool 10 may not include a base and may be attachable to a work table or another surface. In the alternative embodiment shown in FIG. 11, the cutting tool 10 includes a clamp 102 in place of the base described above. In this embodiment, the cutting platform 16, the blade holder 18, the blade 20 and the handle 22 remain similar to the description above. The clamp 102 preferably includes an upper bracket 104 with a support surface 105, a lower bracket 106 and a clamping platform 108 with a threaded adjustment rod 110. In this embodiment, the upper bracket 104 is connected to the adjustable hinge 24. The lower bracket 106 is connected to upper bracket 104 with a threaded connection. Alternatively, the lower bracket 106 can be connected to the upper bracket with a weld connection or the lower bracket 106 can be integrally formed with the upper bracket 104. The threaded adjustment rod 110 extends through the lower bracket 106 and is adjustable to pinch a work surface between the support surface 105 and the clamping platform 110 to prevent the cutting tool 10 from moving during cutting. Alternatively, the cutting tool 10 may be attached to the work surface with a screw through either the upper bracket 104 or the support surface 105 and the work surface.

While in the foregoing specification this invention has been described in relation to certain preferred embodiments thereof, and many details have been set forth for purpose of illustration, it will be apparent to those skilled in the art that the material cutter is susceptible to additional embodiments and that certain of the details described herein can be varied considerably without departing from the basic principles of the invention.

What is claimed is:

1. A cutting tool for cutting a sheet of material, the cutting tool comprising:

a base including a support surface;

a cutting platform including a cutting platform base with a blade stop, the cutting platform pivotally connected to the base, wherein the cutting platform base and the blade stop can be set to a range of angles relative to a plane of the support surface;

a pair of supports extending perpendicularly from the cutting platform;

a pair of axles, each axle rotatably connected to one of the pair of supports;

a pair of cams, each cam connected to one of the pair of the axles; and a blade holder with a blade, wherein a portion of the blade holder is positioned under the pair of cams, where the blade holder and the blade are movable between an open position and a closed position by rotating the pair of cams, wherein the blade moves downward along the supports toward the cutting platform base and contacts the blade stop at a 90° angle for all angles of the cutting platform relative to the plane of the support surface to cut the sheet of material at a cut angle.

2. The cutting tool of claim 1, further comprising:

a handle connected to the cam for rotating the cam.

3. The cutting tool of claim 2, wherein the handle is adjustable relative to the cam.

4. The cutting tool of claim 1, wherein the cut angle ranges from 0 to 45 degrees.

5. The cutting tool of claim 1, further comprising:

a spring positioned between the blade holder and the cutting platform base, the spring biasing the blade holder in the open position.

6. The cutting tool of claim 1, further comprising:

a guide rail positioned on the support surface.

7. The cutting tool of claim 6, further comprising a guide rail track for adjusting a position of the guide rail on the support surface.

8. The cutting tool of claim 1, further comprising:

a hinge for pivotally connecting the cutting platform to the base, and wherein the hinge includes a hinge lock for locking the cutting platform at a plurality of angles relative to the base.

9. A cutting tool for cutting a sheet of material, the cutting tool comprising:

a clamp including a support surface;

a cutting platform including a cutting platform base with a blade stop, the cutting platform connected to the clamp with a hinge, wherein the cutting platform base and the blade stop can be set to a range of angles to a plane of the support surface;

a pair of supports extending from the cutting platform;

a pair of axles, each axle rotatably connected to one of the pair of supports;

a pair of cams, each cam connected to one of the pair of axles; and a blade holder with a blade, the blade holder positioned under at least a portion of the cam, where the blade holder and the blade are movable between an open position and a closed position by rotating the cam, wherein the blade moves downward along the pair of supports and contacts the blade stop at a 90° angle for all angles of the cutting platform relative to the plane of the support surface to cut the sheet of material at a plurality of angles.

10. The cutting tool of claim 9, further comprising:

a handle connected to the cam for rotating the cam.

11. The cutting tool of claim 10, wherein the handle is adjustable relative to the cam.

12. The cutting tool of claim 9, wherein the cut angle ranges from 0 to 45 degrees.

13. The cutting tool of claim 9, further comprising: a spring positioned between the blade holder and the cutting platform base, the spring biasing the blade holder to the open position.

14. The cutting tool of claim 9, further comprising:

a guide rail positioned on the support surface.

15. The cutting tool of claim 14, further comprising a guide rail track for adjusting a position of the guide rail on the support surface.

16. The cutting tool of claim 9, wherein the hinge includes a hinge lock for locking the cutting platform at a plurality of angles relative to the support surface.

17. A cutting tool for cutting a sheet of material, the cutting tool comprising:

a base defining a support surface;

a cutting platform including a cutting platform base and a blade stop, the cutting platform pivotally connected to the base with a hinge, wherein the cutting platform base and the blade stop can be adjusted to a range of angles relative to a plane of the support surface;

a pair of supports extending perpendicular from the cutting platform base;

a pair of axles, each axle rotatably connected to one of the pair of supports;

a pair of cams, each cam connected to one of the axles, each cam including an edge with a gradually increasing radius from a small radius to a large radius, the cams positioned over a portion of the cutting platform; and a blade holder with a blade, the blade holder positioned in contact with at least a portion of the cams, wherein the blade holder and the blade are in an open position when the small radius of the cam contacts the blade holder and wherein the blade holder and the blade are in a closed position when the large radius of the cam contacts the blade holder, and wherein the blade contacts the blade stop at a 90° angle for all angles of the cutting platform relative to the plane of the support surface.

18. The cutting tool of claim 17, further comprising:

a handle connected to the cam for rotating the cam, wherein the handle is adjustable relative to the cam.

19. The cutting tool of claim 17, further comprising:

a guide rail positioned on the support surface.

20. The cutting tool of claim 19, further comprising a guide rail track for adjusting a position of the guide rail on the support surface.

* * * * *